US006609918B2

(12) United States Patent
Uchikawa

(10) Patent No.: US 6,609,918 B2
(45) Date of Patent: Aug. 26, 2003

(54) PUSH-BUTTON MECHANISM FOR EJECTING AN ELECTRONICS CARD FROM AN ELECTRICAL CONNECTOR

(75) Inventor: Yukihisa Uchikawa, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/908,328

(22) Filed: Jul. 18, 2001

(65) Prior Publication Data

US 2002/0009911 A1 Jan. 24, 2002

(30) Foreign Application Priority Data

Jul. 21, 2000 (JP) ..... 2000-221442

(51) Int. Cl.[7] ..... H01R 13/62
(52) U.S. Cl. ..... 439/159; 439/160
(58) Field of Search ..... 439/152–160, 439/372

(56) References Cited

U.S. PATENT DOCUMENTS 5,197,894 A * 3/1993 Koike ..... 439/159
5,558,527 A * 9/1996 Lin ..... 439/159
5,836,775 A 11/1998 Hiyama et al.
5,846,096 A 12/1998 Ishida
6,030,238 A * 2/2000 Dong ..... 439/159
6,042,402 A * 3/2000 Tung et al. ..... 439/159
6,059,589 A 5/2000 Nishioka
6,065,984 A * 5/2000 Tung ..... 439/159
6,113,403 A * 9/2000 Oguchi ..... 439/159
6,146,164 A * 11/2000 Tung ..... 439/159

FOREIGN PATENT DOCUMENTS

| | | |
|---|---|---|
| JP | 6-80276 | 11/1994 |
| JP | 10189140 | 7/1998 |
| JP | 11224726 | 8/1999 |
| JP | 2000195587 | 7/2000 |

* cited by examiner

*Primary Examiner*—Hien Vu
(74) *Attorney, Agent, or Firm*—W. F. Fasse; W. G. Fasse

(57) ABSTRACT

An actuating mechanism for effecting the ejection of an electronics card from an electrical connector has a reduced cost, reduced component wear, simple assembly, and compact space-saving structure. The actuating mechanism includes a rotary shaft that engages with or disengages from an ejection mechanism for loading and unloading a card, and exerts an ejection force to the ejection mechanism when the rotary shaft engages with the ejection mechanism. Switching between engagement and disengagement is effected by rotation of this rotary shaft, and the rotation is effected by the interaction of wave-shaped cams provided on the rotary shaft and on an axially slidable pushrod.

7 Claims, 15 Drawing Sheets

The case where the angle of rotation in one cycle is about 180 degrees

The case where the angle of rotation in one cycle is about 120 degrees

PUSH-BUTTON MECHANISM FOR EJECTING AN ELECTRONICS CARD FROM AN ELECTRICAL CONNECTOR

BACKGROUND OF THE INVENTION

1. Field of the Invention

The present invention belongs to a technical field of electric connectors for cards, which receive cards such as IC cards, and particularly relates to an electric connector for cards, which is provided with an ejection mechanism for ejecting an inserted card.

2. Related Art

As electric connectors for cards of this kind, connectors are known, which are provided with an ejection mechanism using a heart-shaped cam groove. For example, Japanese Patent unexamined publication gazette Heisei 11-224726 discloses an electric connector for cards, which comprises a housing having contacts for connecting a card, a frame that supports a card in a disconnectable manner, and a flexible pushrod that can be reciprocated between a pushed-in position and a protruding position, wherein when a card is inserted, the pushrod is set in the pushed-in position by a locking mechanism having a heart-shaped cam groove, and under this condition, if the pushrod is pushed, locking of the pushrod will be undone and the pushrod will shift to the protruding position, and under this condition, if the pushrod is pushed, the card will be ejected by means of the pushrod. In this connector, a part of the pushrod is made to trace the heart-shaped cam groove, and the connector is provided with an ejection arm that can be engaged with and disengaged from the pushrod, and if the pushrod is pushed when it is in the protruding position, the pushrod will trace the heart-shaped cam groove and the pushrod will drive the ejection arm to discharge the card by means of the ejection arm, and the pushrod is made to be locked in the pushed-in position by the heart-shaped cam groove. Moreover, when the pushrod is in the pushed-in position, the pushrod is locked by means of the heart-shaped cam groove and the pushrod and the ejection arm are not engaged with each other, and under this pushed-in condition if the pushrod is pushed, the pushrod being free from the ejection arm will trace the heart-shaped cam groove to come to the protruding position.

In this connector, a part of the pushrod is made to trace the heart-shaped cam groove, and as the pushrod is made of a metal and the heart-shaped cam groove is made of a resin, the wear is excessive. To reduce this wear and achieve smooth tracing, grease is applied to the contacting parts and the contacting part of the metallic side is smoothed. Such measures, however, increase the cost. Furthermore, as tracing of a part of the pushrod in the heart-shaped cam groove is effected by movement in a plane, the ejection mechanism tends to be bulky. Moreover, to ensure smooth tracing, it is necessary to carefully assemble the pushrod, heart-shaped cam groove, etc. This difficulty of assembly results in higher cost.

SUMMARY OF THE INVENTION

The present invention was made in view of the above-mentioned points, and one object of the invention is to provide a member, which engages with or disengages from an ejection mechanism for loading and unloading a card and gives an ejecting force to the ejection mechanism when the member engages with the ejection mechanism, and switching between engagement and disengagement is effected by rotation of the member, and this rotation is effected by use of wave-shaped cams to eliminate needs of countermeasures against friction of the member to reduce costs, and to improve space-saving and ease in assembly to further cost reduction.

To accomplish the above-mentioned object, the electric connector for cards of the present invention comprises: a body into which a card is to be inserted; an ejection mechanism, which has a slider that linearly reciprocates between a first position and a second position, said ejection mechanism being provided on said body, in said ejection mechanism when a card is inserted into a connection position, the slider will be pushed by the card to move from the second position to the first position, and when the slider is pushed back from the first position to the second position, said ejection mechanism will push out the card from the connection position in a discharge direction; a rotary shaft, of which center of rotation is parallel to the direction of shift of the slider and is kept away by an offset from a passage space of the slider, said rotary shaft being provided, on its external circumferential face near its top end, with an engagement part and an escapement part being formed in the circumferential direction, the engagement part extending in the radial direction by more than the offset from the center of rotation of said shaft, the escapement part extending in the radial direction by less than the offset from the center of rotation of said shaft, said shaft being provided with a guide protrusion formed closer to the root end of said shaft than the engagement part and the escapement part, and said shaft being provided, on its end face of the root end, with a wave-shaped cam of a shifting side, the cam being continuous in the circumferential direction; a holder cylinder, which is provided on the body, into which, on its top end side, said rotary shaft, at least its part from the guide protrusion down to the root end is fitted shiftably in the axial direction and rotatably, said holder cylinder being provided, on its inner circumferential face, with two kinds of guide grooves, one kind being short and the other being long, the guide grooves extending from the top end in the axial direction to receive the guide protrusion of said rotary shaft, the longer guide groove or first guide groove being formed in such a position on the circumference that when the guide protrusion enters into the first guide groove, the engagement part will get into the passage space of the slider and engage with the slider on a side to prevent its advancement, and the shorter guide groove or second guide groove being formed in such a position on the circumference that when the guide protrusion enters into the second guide groove, the engagement part will move away from the passage space of the slider and the escapement part will be kept away from the passage space of the slider; an energizing member for energizing said rotary shaft towards said holder cylinder; and a pushrod, which is fitted into said holder cylinder on its root end side in such a way that said pushrod does not come off said holder cylinder and said pushrod can be shifted in the axial direction and is prevented from rotation, said pushrod having, on the end face of the top end, a fixed-side wave-shaped cam that contacts the shifting-side wave-shaped cam of the rotary shaft and is formed continuously in the circumferential direction, the root end of said pushrod being formed into a button, and when the button is pushed and released, said pushrod will reciprocate in the axial direction, and in the outward movement said pushrod will push said rotary shaft and make the guide protrusion come out of said holder cylinder, and said pushrod will make the shifting-side wave-shaped cam slide along the fixed-side wave-shaped cam to rotate said rotary shaft in one direction, and in the homeward movement said pushrod will put the guide protrusion into an adjoining guide groove.

Actions of this electric connector for cards are as follows. In the initial position, the guide protrusion of the rotary shaft is in the shorter groove or second guide groove of the holder cylinder. As the second guide groove is shorter, the length of insertion of the rotary shaft into the holder cylinder gets shorter, and accordingly, the pushrod gets into the holder cylinder deeper, and the protrusion of the pushrod from the holder cylinder is shorter. Under this condition, the engagement part of the rotary shaft moved away from the passage space of the slider, and the escapement part is kept away from the passage space of the slider. Accordingly, the slider of the ejection mechanism has been advanced, by the card that is inserted into the connection position, from the second position to the first position. This advancement, however, does not bring about contact between the slider and the rotary shaft nor any movement of the rotary shaft and the pushrod.

When the card is to be discharged, first the button is depressed once by working against the energizing force of the energizing member. The pushrod will reciprocate one cycle in the axial direction. In the outward movement, the pushrod will push said rotary shaft to make the guide protrusion come out of the holder cylinder and have the shifting-side wave-shaped cam slide along the fixed-side wave-shaped cam to rotate the rotary shaft in one direction. In the homeward movement, the guide protrusion will get into the adjoining first guide groove. As the first guide groove is longer, the length of insertion of the rotary shaft into the holder cylinder gets longer, and the pushrod will be pushed out from the holder cylinder by the difference between the lengths of both the guide grooves, and the length of protrusion of the pushrod from the holder cylinder will get longer in comparison with that in the initial position. In this case, the engagement part of the rotary shaft will come into the passage space of the slider and will engage with the slider on the side of preventing its advancement. Accordingly, when the button is pressed once more against the energizing force of the energizing member, the pushrod will reciprocate one cycle in the axial direction, and in the outward movement, the pushrod will push the rotary shaft to make the guide protrusion come out of the holder cylinder and have the shifting-side wave-shaped cam slide over the fixed-side wave-shaped cam to rotate the rotary shaft in one direction. In the homeward movement, the guide protrusion will get into the adjoining second guide groove and return to the initial position. During this course, in the outward movement, the engagement part engages with the slider and pushes back the slider from the first position to the second position, and the card will be pushed out from the connection position in the discharge direction.

As described above, this electric connector for cards is provided with a rotary shaft, which engages with or disengages from the slider and gives an ejecting force to the slider when the rotary shaft engages with the slider, and switching between the engagement with and disengagement from the slider is effected by rotation of the rotary shaft, and this rotation is effected by use of wave-shaped cams. As a result, the rotary shaft, holder cylinder, pushrod, etc. can be formed of the same material, and countermeasures against friction between members are not required in comparison with the connector with an ejection mechanism using a heart-shaped cam groove. Moreover, as members make rotary shifts rather than shifts in a plane, ease of assembly is improved.

This electric connector for cards is provided with a rotary shaft, which engages with or disengages from the slider and gives an ejecting force to the slider when the rotary shaft engages with the slider, and switching between the engagement with and disengagement from the slider is effected by rotation of the rotary shaft, and this rotation is effected by use of wave-shaped cams. As a result, the rotary shaft, holder cylinder, pushrod, etc. can be formed of the same material. Hence in comparison with a connector with an ejection mechanism using a heart-shaped cam groove, countermeasures against friction of members are not needed, and this contributes to reduction in cost. Moreover, as the members do not shift in a plane and the members make rotary shifts, space-saving is improved. Furthermore, cost can be reduced further through improvement in ease of assembly.

BRIEF DESCRIPTION OF THE DRAWINGS

FIG. 5A is a plan view showing the state when the slider is in the first position. FIG. 5B is a side view, FIG. 5C is a view seen from the top end side, and FIG. 5D is a view seen from the root end side.

FIG. 6A shows the engagement part being present in the passage space of the slider and engaging with the slider on a side of preventing its advancement. FIG. 6B is an enlarged sectional view along the line 6B—6B of FIG. 3 and shows the engagement part being out of the passage space of the slider and the escapement part not obstructing the passage space of the slider.

FIG. 8A is a plan view, FIG. 8B is a view seen from the top end side, and FIG. 8C is a view seen from the root end side.

FIG. 10A is a plan view, FIG. 10B is a side view, FIG. 10C is a view seen from the top end side, and FIG. 10D is a view seen from the root end side.

FIG. 15A shows the case of the embodiment, and the angle of rotation is about 180 degrees. FIG. 15B shows the case of a modification, and the angle of rotation is about 120 degrees.

DETAILED DESCRIPTION OF PREFERRED EMBODIMENTS OF THE INVENTION

Figure 1:
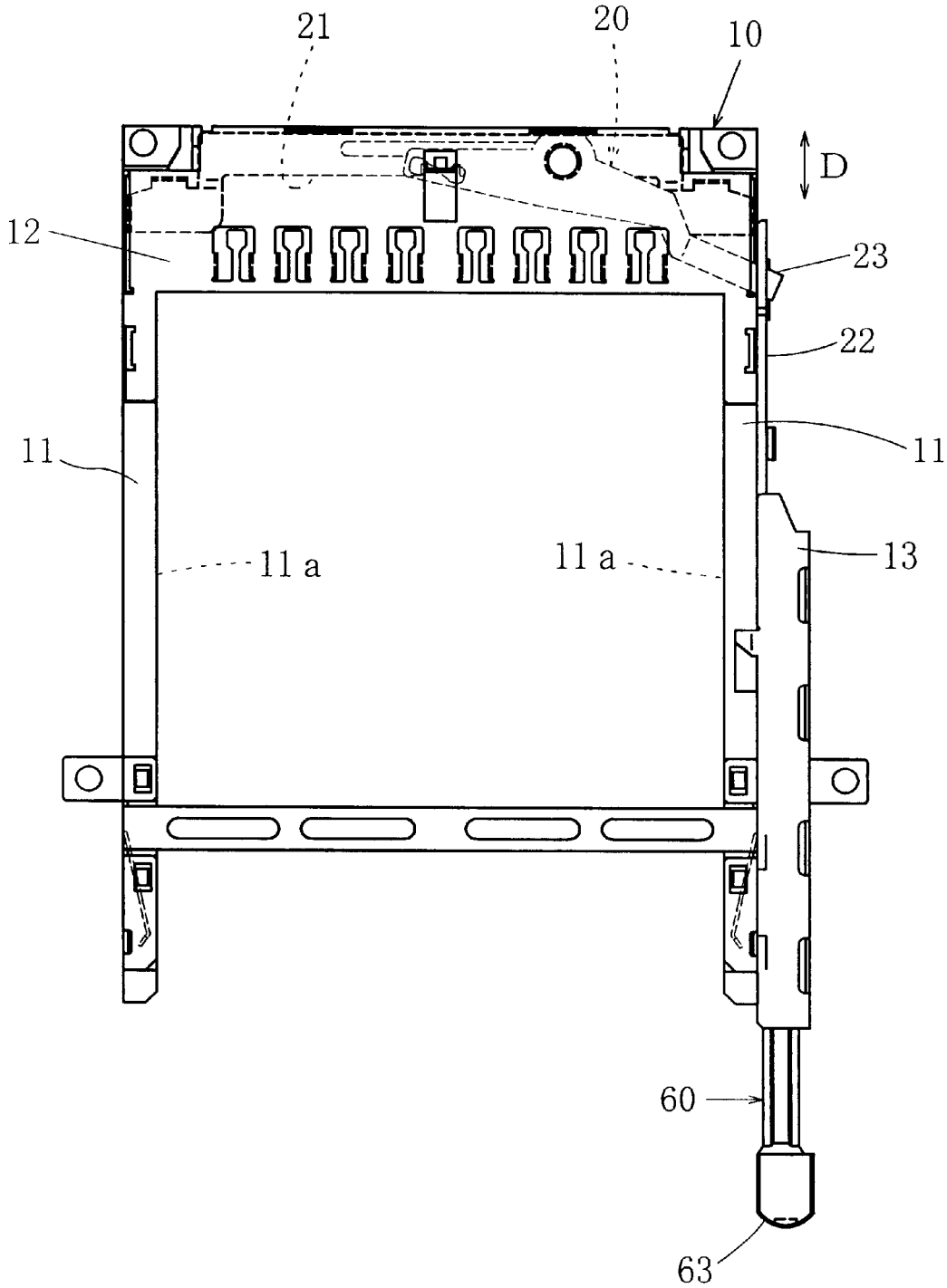
FIG. 1 is a plan view of the electric connector for cards of an embodiment of the present invention.
Figure 2:
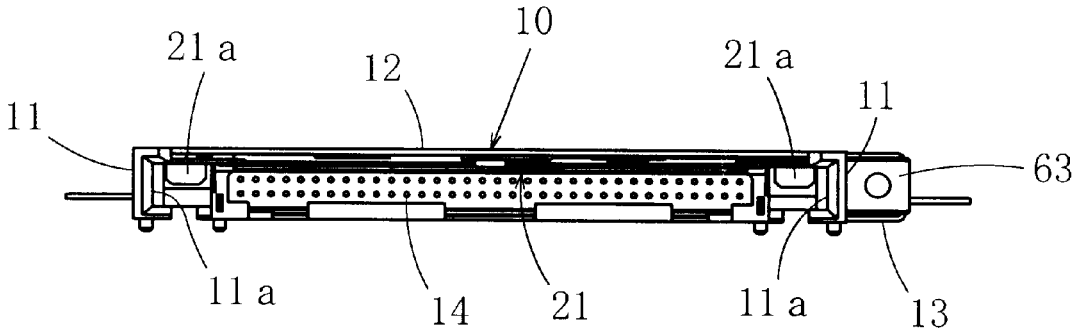
FIG. 2 is a front view of the electric connector for cards of the embodiment.

In the following, the electric connector for cards of the embodiment of the present invention will be described. FIG. 1 and FIG. 2 show the electric connector for cards of the embodiment.

In FIG. 1 and FIG. 2, 10 denotes the body into which a card 1 such as an IC card is inserted. This body 10 is provided with two rails 11, which are arranged in parallel with each other and have longitudinal grooves 11*a* cut in their opposing faces, a main frame 12 connecting the two rails 11, and a side frame 13 being located on one side of one of the rails 11. The card 1 is inserted by placing the side edges of the card 1 into the grooves 11*a* of the two rails 11 from this side in the longitudinal direction of the rails 11 towards the deeper side. In this embodiment, fixed-side contacts 14 are provided in the deep of the body 10, and when the card 1 is inserted into the connection position, the shifting-side contacts of the card 1 will be connected to the fixed-side contacts 14. The present invention includes an embodiment of a body, which is provided with a transmitter and a receiver and when a card is inserted into the connection position, electronic information will be exchanged without direct contact between the card and the transmitter and the receiver. The present invention also includes an embodiment wherein the fixed-side contacts and the transmitter and the receiver are separated from the body and are provided on a peripheral member. In the present embodiment, from the viewpoint of ease of assembly of the members, etc., the body 10 is composed of three members, but this does not limit in any way the configuration of the body of the present invention. The body may have a different configuration provided that a card can be inserted into the body.

This body 10 is provided with an ejection mechanism 20 that pushes out the card 1 from the connection position in the discharge direction. This ejection mechanism 20 is provided on the above-mentioned body 10, and the ejection mechanism 20 has a slider 22 that linearly reciprocates between the first position shown in FIG. 3 and the second position shown in FIG. 4. In this embodiment, the slider shifts along the rail 11, and the first position of the slider 22 is ahead of the second position in the direction of card ejection. However, the shifting direction of the slider and the positional relationship between the first position and the second position of the slider are not limited in any way by this embodiment. This ejection mechanism 20 exhibits functions that when the card 1 is inserted into the connection position shown in FIG. 3, the slider 22 will be pushed by the card 1 to advance from the second position to the first position, and when the slider 22 is pushed back from the first position to the second position, the ejection mechanism 20 will push out the card 1 from the connection position in the discharge direction. The ejection mechanism 20 of the present embodiment comprises an ejection member 21 that slides in the insertion direction of the card 1 and contacts the top end side 1*a* of the card 1, a slider 22 that is slidably provided on the body 10, and a linkage 23 that connects the ejection member 21 and the slider 22. Both the ends of the ejection member 21 in its longitudinal direction are loosely fitted into the grooves 11*a* of the two rails 11, and with this arrangement, the ejection member 21 slides in the insertion direction of the card 1. Pawls 21*a* rising from end edges contact the top end side 1*a* of the card 1. The slider 22 is slidably provided, by means of a fitting structure of an elongated hole and a pin, on the outer side face of the rail 11 being a part of the body 10. As for the linkage 23, its middle part is rotatably provided on an axis provided on the body 10. With this arrangement, when the card 1 is inserted to the connection position, the ejection member 21 will be pushed by the card 1 to slide, and the linkage 23 will be swung to make the slider 22 advance from the second position to the first position. When the slider 22 is pushed back from the first position to the second position, the linkage 23 will be swung to make the ejection member 21 slide. The card 1 will be pushed out by this ejection member 21 from the connection position in the discharge direction.

This electric connector for cards further comprises a rotary shaft 30 that engages with the slider 22 or disengages from the slider 22, a holder cylinder 40 into which the rotary shaft 30 is fitted, an energizing or elastic biasing member 50 such as a spring that energizes or biases or urges the rotary shaft 30 toward the holder cylinder 40, and a pushrod 60 that is fitted into the holder cylinder 40. In this embodiment, along the rail 11 on which the slider 22 is provided, the energizing member 50, the rotary shaft 30, the holder cylinder 40 and the pushrod 60 are arranged in this order in the discharge direction of the card 1. The order of arrangement of these members is not limited in any way by this embodiment. In each of members 30, 40, 50 and 60, the end that is closer to the slider 22 is called the top end, and the end that is more distant from the slider 22 is called the root end.

Figure 6A:
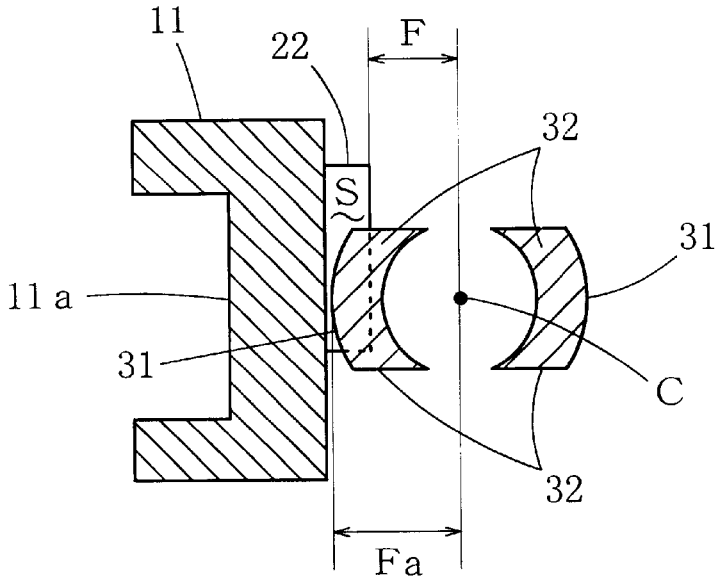
FIG. 6A and FIG. 6B are enlarged sectional views of the rail, slider and rotary shaft.
Figure 6B:
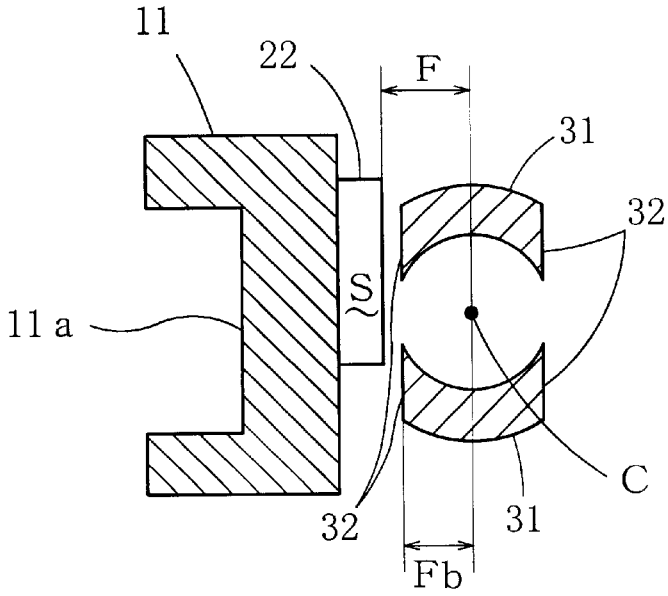
Figure 7:
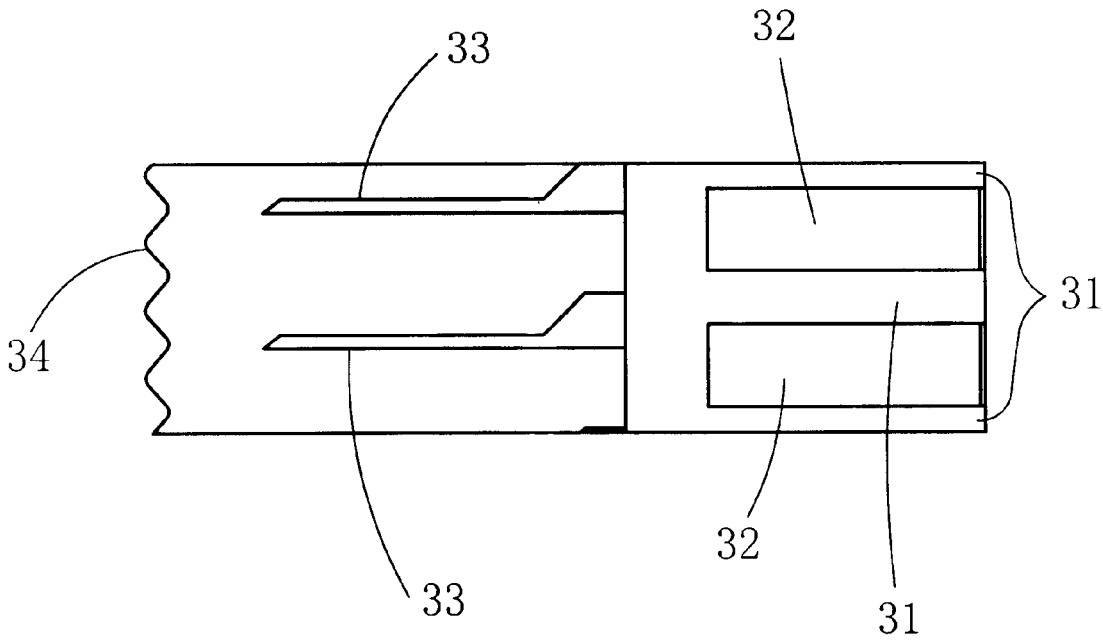
FIG. 7 is an explanatory drawing showing a magnified development of the external circumferential face of the rotary shaft of the embodiment.

FIG. 5A, FIG. 5B, FIG. 5C and FIG. 5D show the rotary shaft 30. As shown in FIG. 3, FIG. 4, FIG. 6A and FIG. 6B, the center of rotation C of this rotary shaft 30 is arranged to be parallel to the shifting direction D of the above-mentioned slider 22 and be away by an offset F from the passage space S of the slider 22. As shown in FIG. 6A and FIG. 6B, on the external circumferential face of the rotary shaft 30 near its top end, engagement parts 31, which extend in the radial direction from the center of rotation C of the shaft 30 to a dimension Fa exceeding the offset F, and escapement parts 32, which extend in the radial direction from the center of rotation C of the shaft 30 to a dimension Fb being shorter than the offset F, are formed in the circumferential direction. Guide protrusions 33 are also formed closer to the root end than the engagement parts 31 and the escapement parts 32. Moreover, on the end face of the root end, shifting-side wave-shaped cam 34 is formed continuously in the circumferential direction. As shown in FIG. 7 showing the development of the external circumferential face of the rotary shaft 30, in this embodiment, two engagement parts 31 and two escapement parts 32 are provided, and the engagement parts 31 and the escapement parts 32 are alternately arranged in the circumferential direction of the rotary shaft 30. Two guide protrusions 33 are also provided.

Figure 8A:
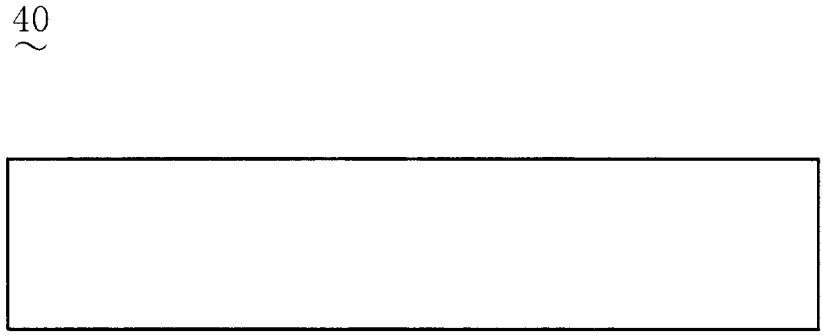
FIG. 8A, FIG. 8B and FIG. 8C are enlarged views of the holder cylinder of the electric connector for cards of the embodiment.
Figure 8B:
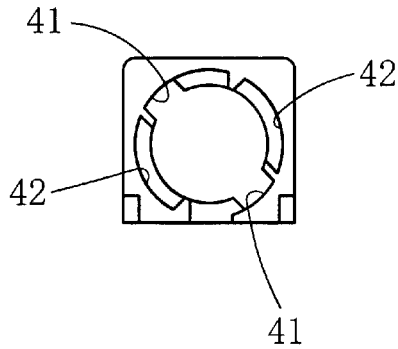
Figure 8C:
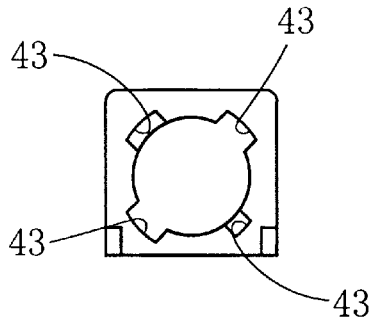
Figure 9:
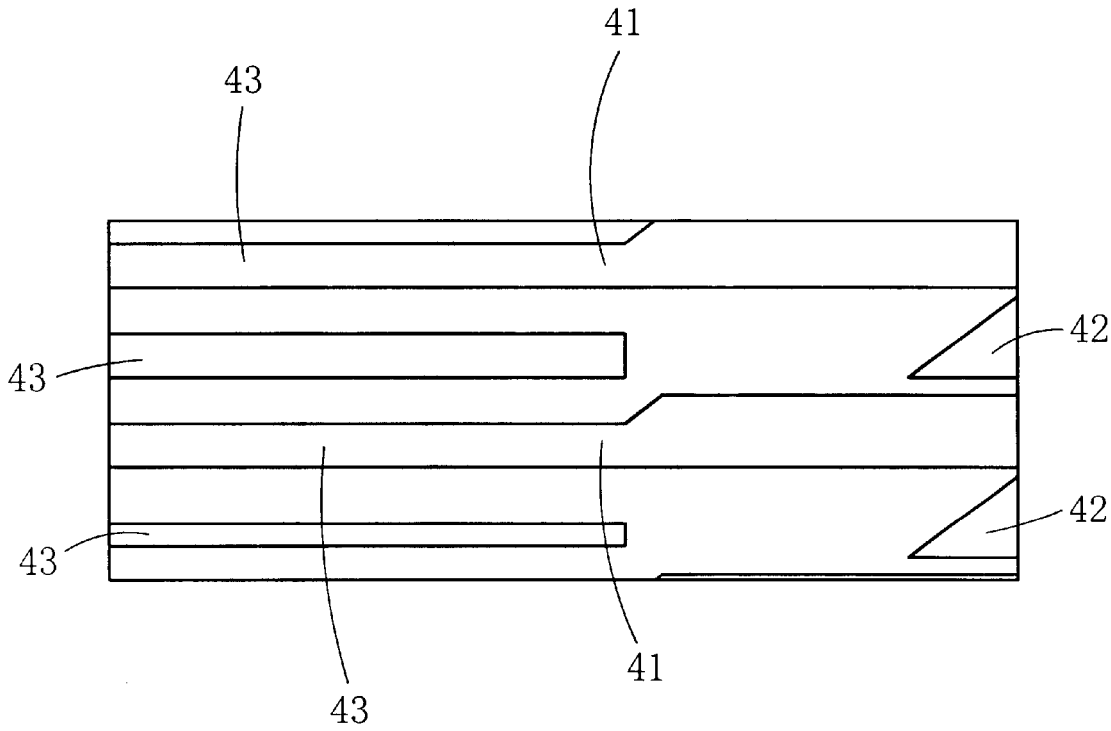
FIG. 9 is an explanatory drawing showing an enlarged development of the internal circumferential face of the holder cylinder of the embodiment.
Figure 10A:
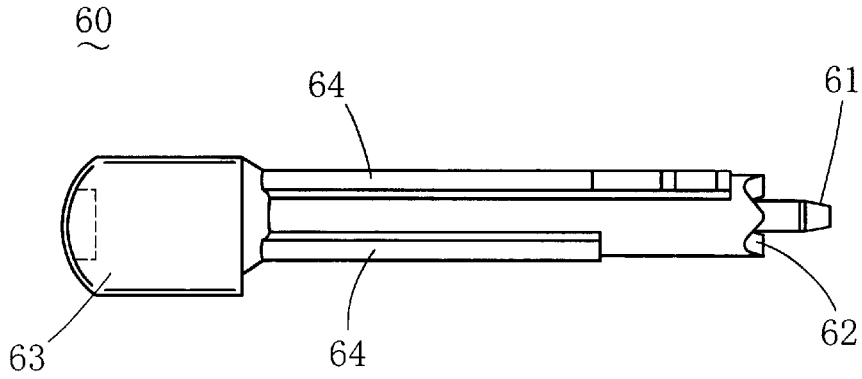
FIG. 10A, FIG. 10B, FIG. 10C and FIG. 10D show enlarged views of the pushrod of the electric connector for cards of the embodiment.
Figure 10B:
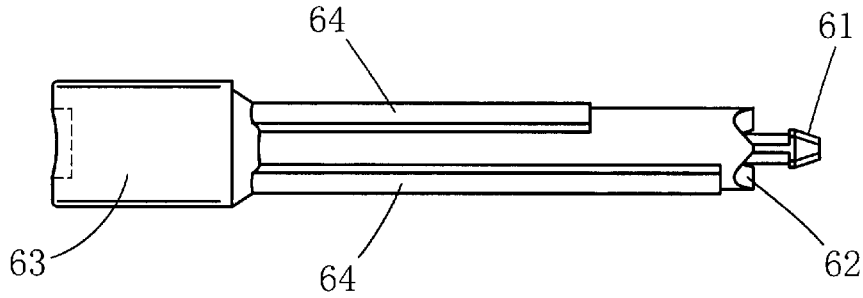
Figure 10C:
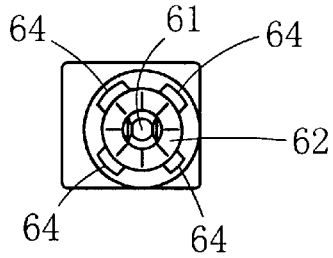
Figure 10D:
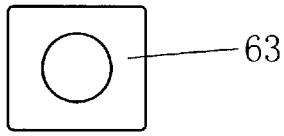

FIG. 8A, FIG. 8B and FIG. 8C show the holder cylinder 40. This holder cylinder 40 has a through hole in its longitudinal direction and is fixed onto the body 10. In this embodiment, the holder cylinder 40 is assembled into the side frame 13 being a part of the body 10. A part of the above-mentioned rotary shaft 30, at least the root end side beyond the guide protrusions 33 is fitted shiftably in the axial direction and rotatably into the top end side of the holder cylinder 40. As shown in FIG. 9 being a development of the internal circumferential face of the holder cylinder 40, in the inner circumferential face of the holder cylinder 40, two kinds, long and short, of guide grooves 41, 42, which extend from the top end in the axial direction to receive guide protrusions 33 of the rotary shaft 30, are formed side by side in the circumferential direction. The longer or first guide groove 41 is formed in such a position on the circumference that when the guide protrusion 33 enters into the first guide groove 41, the engagement part 31 will get into the passage space S of the slider 22 and engage with the slider 22 on a side to prevent its advancement. The shorter or second guide groove 42 is formed in such a position on the circumference that when the guide protrusion 33 enters into the second guide groove 42, the engagement part 31 will move away from the passage space S of the slider 22 and the escapement part 32 will be oriented toward but spaced away from the passage space S of the slider 22. In this embodiment, two first guide grooves 41 and two second guide grooves 42 are provided, and the first guide grooves 41 and the second guide grooves 42 are alternately arranged in the circumferential direction of the holder cylinder 40.

Figure 3:
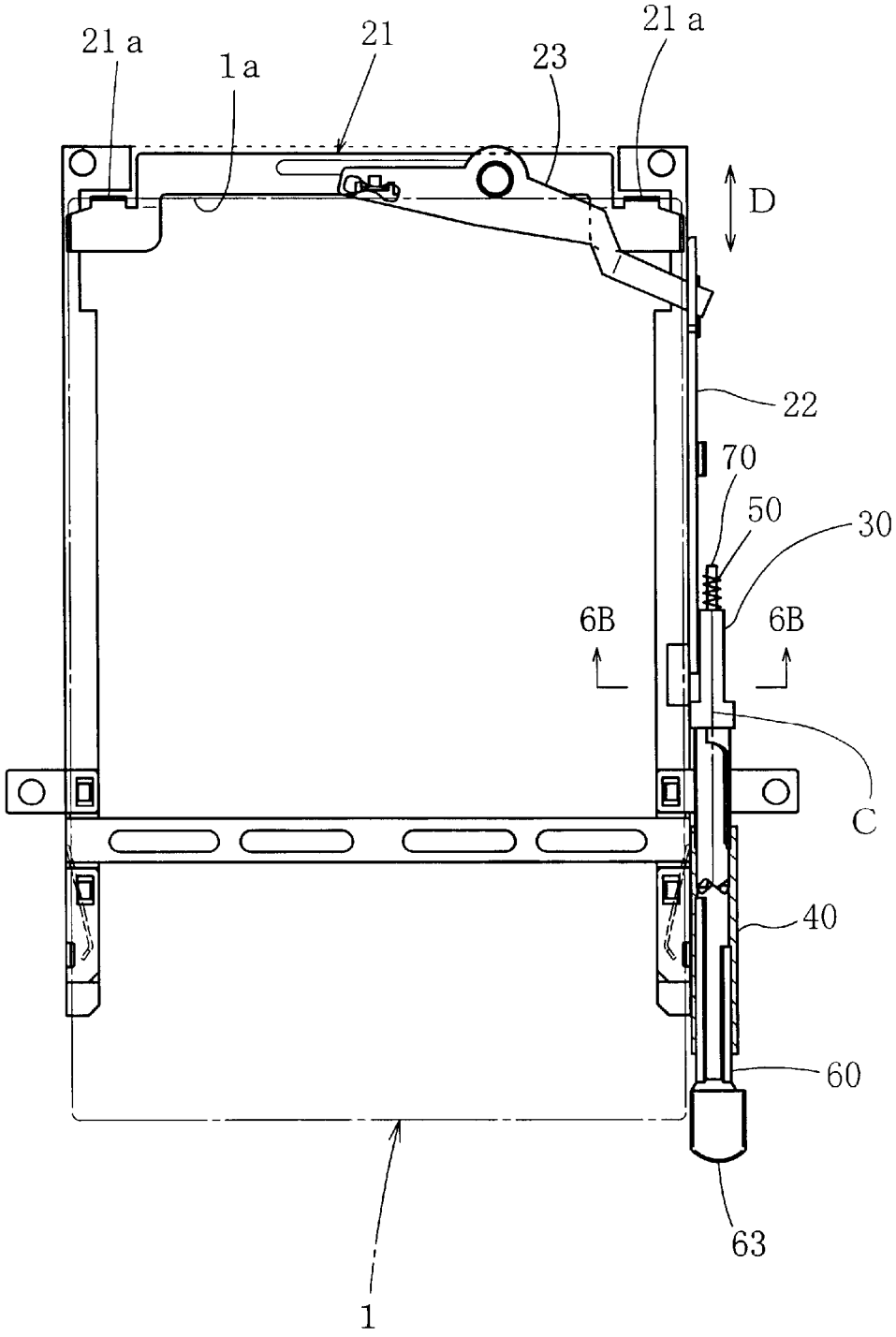
FIG. 3 is a partially-cutaway plan view of the electric connector for cards of the embodiment showing the connector when the slider is in the first position.
Figure 4:
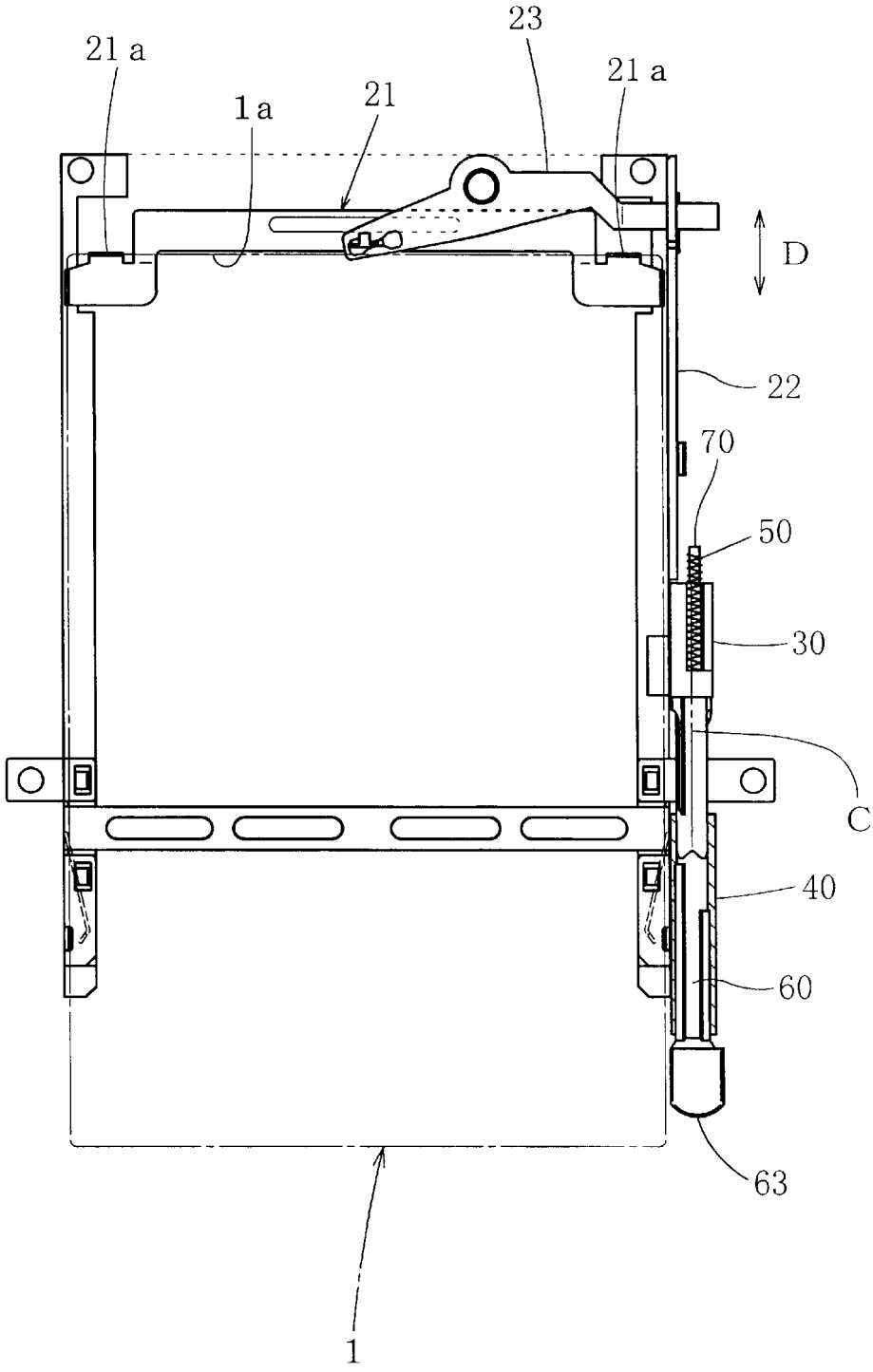
FIG. 4 is a partially-cutaway plan view of the electric connector for cards of the embodiment showing the connector when the slider is in the second position.
Figure 5A:
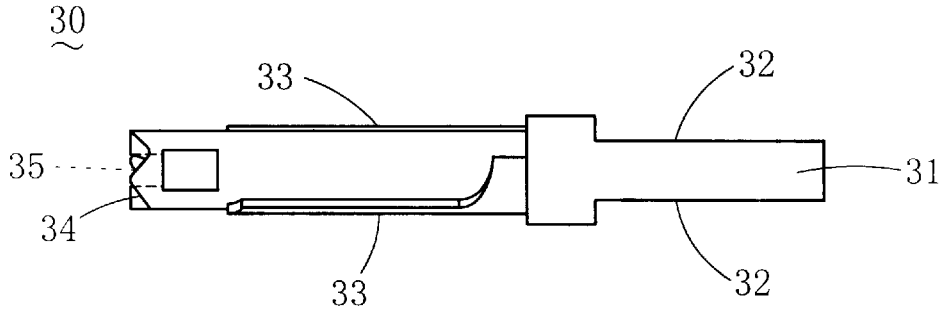
FIG. 5A, FIG. 5B, FIG. 5C and FIG. 5D are enlarged views of the rotary shaft of the electric connector for cards of the embodiment.
Figure 5B:
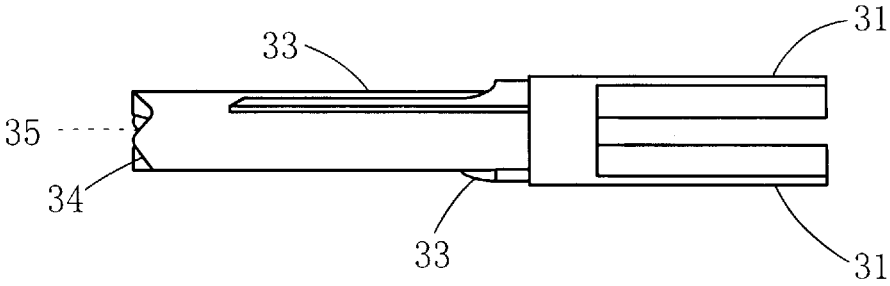
Figure 5C:
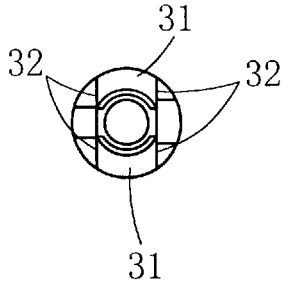
Figure 5D:
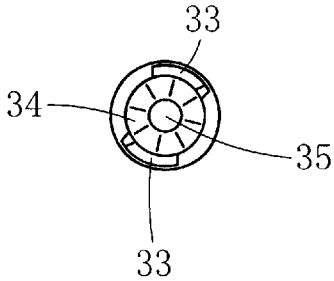

As shown in FIG. 3 and FIG. 4, the body 10 is provided with the energizing member 50 that energizes the rotary shaft 30 towards the holder cylinder 40. In this embodiment, the energizing member 50 is a coil spring, and the energizing member 50 is compressively loaded between the side frame 13 of the body 10 and the rotary shaft 30. The energizing member is not limited in any way to a coil spring, other members will do provided that they have elasticity and exhibit elastic restoring force.

Figure 11:
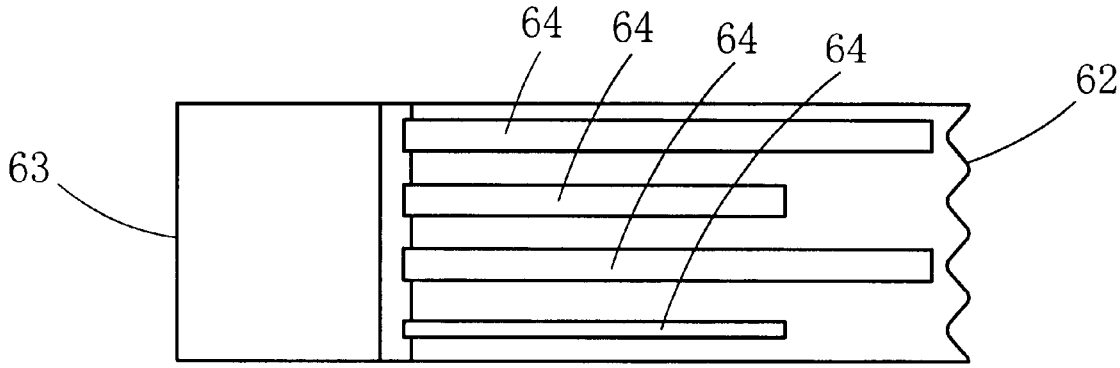
FIG. 11 is an explanatory drawing showing an enlarged development of the outer circumferential face of the pushrod of the embodiment.

FIG. 10A, FIG. 10B, FIG. 10C and FIG. 10D show the pushrod 60. The pushrod 60 is fitted into the holder cylinder 40 on its root end side in such a way that the pushrod 60 does not come off the holder cylinder 40 and the pushrod can be shifted in the axial direction and is prevented from rotation. In this embodiment, a connecting hole 35 expanding inwardly is formed at the center of the end face of the root end of the rotary shaft 30. A connecting protrusion 61, which has a swelling part at its top end and is to be connected to the above-mentioned connecting hole 35, is provided at the center of the end face of the top end of the pushrod 60. The swelling part of the connecting protrusion 61 gets into the connecting hole 35 through the use of flexibility of the swelling part and the connecting hole 35. With this arrangement, the rotary shaft 30 and the pushrod 60 can shift together while permitting relative rotation and without separating from each other in the axial direction. As a result, the pushrod 60 does not come off the holder cylinder 40. Morever, in this embodiment, anti-rotation protrusions 64 are provided on the outer circumferential face of the pushrod 60, and anti-rotation grooves 43, into which the anti-rotation protrusions 64 are slidably fitted, are formed in the inner circumferential face of the holder cylinder 40. Thus the pushrod 60 is fitted into the holder cylinder 40 in such a way that the pushrod 60 can shift in the axial direction and is prevented from rotation. In this embodiment, the anti-rotation grooves 43 are formed continuous to the first guide grooves 41. As shown in FIG. 11 showing a development of the outer circumferential face of the pushrod 60, fixed-side wave-shaped cam 62, which is to contact the shifting-side wave-shaped cam 34 of the rotary shaft 30, is formed continuously in the circumferential direction on the end face of the top end of the pushrod 60. The root end of the pushrod 60 is formed into a button 63. When the button 63 is pushed and released, the pushrod 60 will reciprocate in the axial direction, and in the outward movement the pushrod 60 will shift the rotary shaft 30 to make the guide protrusions 33 come out of the holder cylinder 40, and make the shifting-side wave-shaped cam 34 slide along the fixed-side wave-shaped cam 62 to rotate the rotary shaft 30 in one direction, and in the homeward movement the pushrod 60 will put the guide protrusions 33 into the adjoining guide grooves 41 or the adjoining guide grooves 42. Since there are other structures for preventing the pushrod from coming off the holder cylinder and other structures for fitting the pushrod so that it can shift in the axial direction and is prevented from rotation, the present invention is not limited in any way by the structure of this embodiment.

In this embodiment, a guide hole is formed in the rotary shaft 30 on the top end side along the center of rotation C, and one end of the coil spring being the energizing member 50 is received by this guide hole. The other end of the coil spring is received by the side frame 13 of the body 10. As shown in FIG. 3 and FIG. 4, a guide rod 70 is arranged along the winding center of the coil spring, and one end of this guide rod 70 is supported by the side frame 13 of the body 10. However, as there are other forms for guiding the energizing member, the present invention is not limited in any way by the structure of this embodiment.

Figure 12:
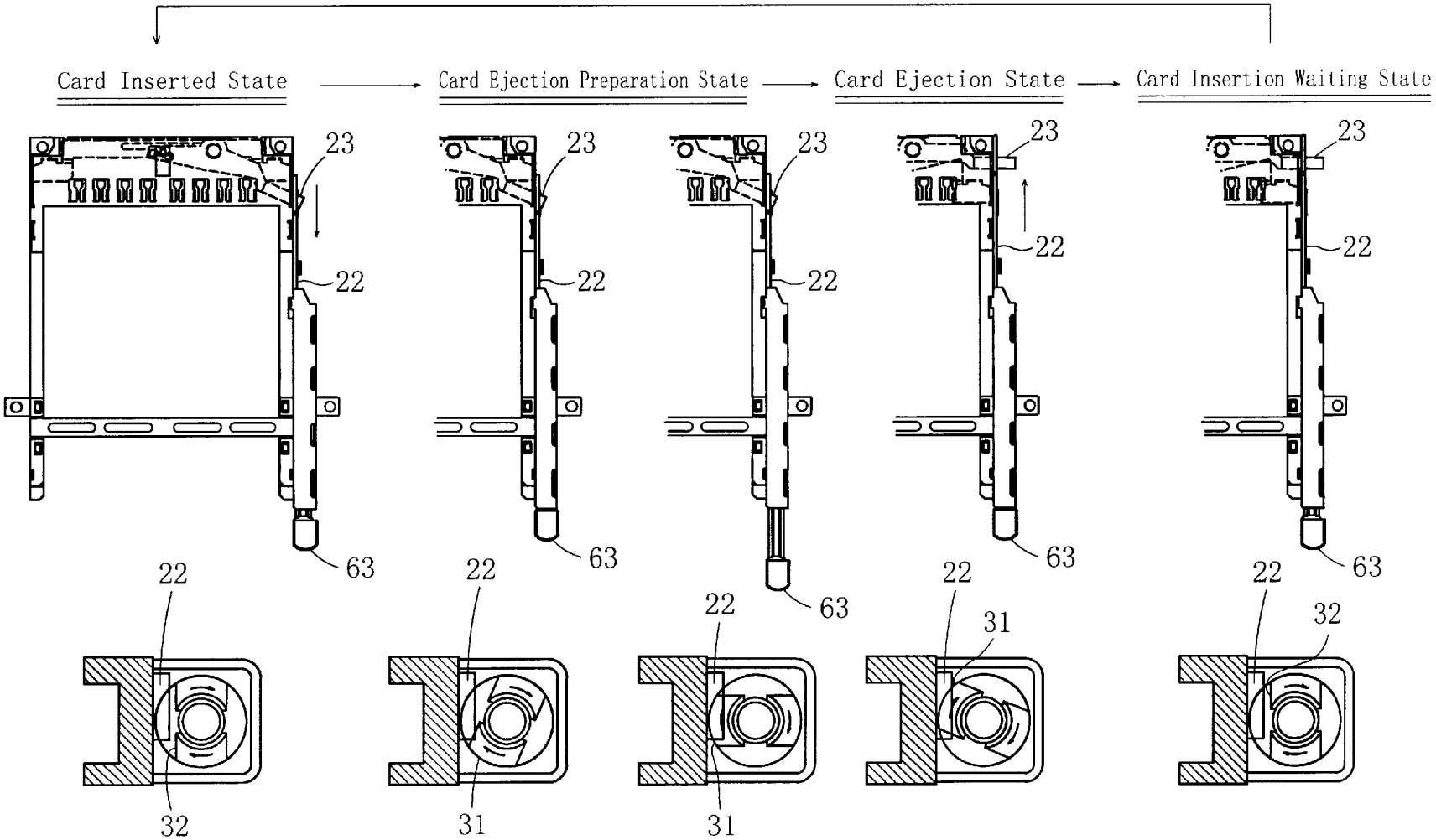
FIG. 12 is an explanatory drawing illustrating the states of rotation of the rotary shaft according to the reciprocation of the pushrod.
Figure 13:
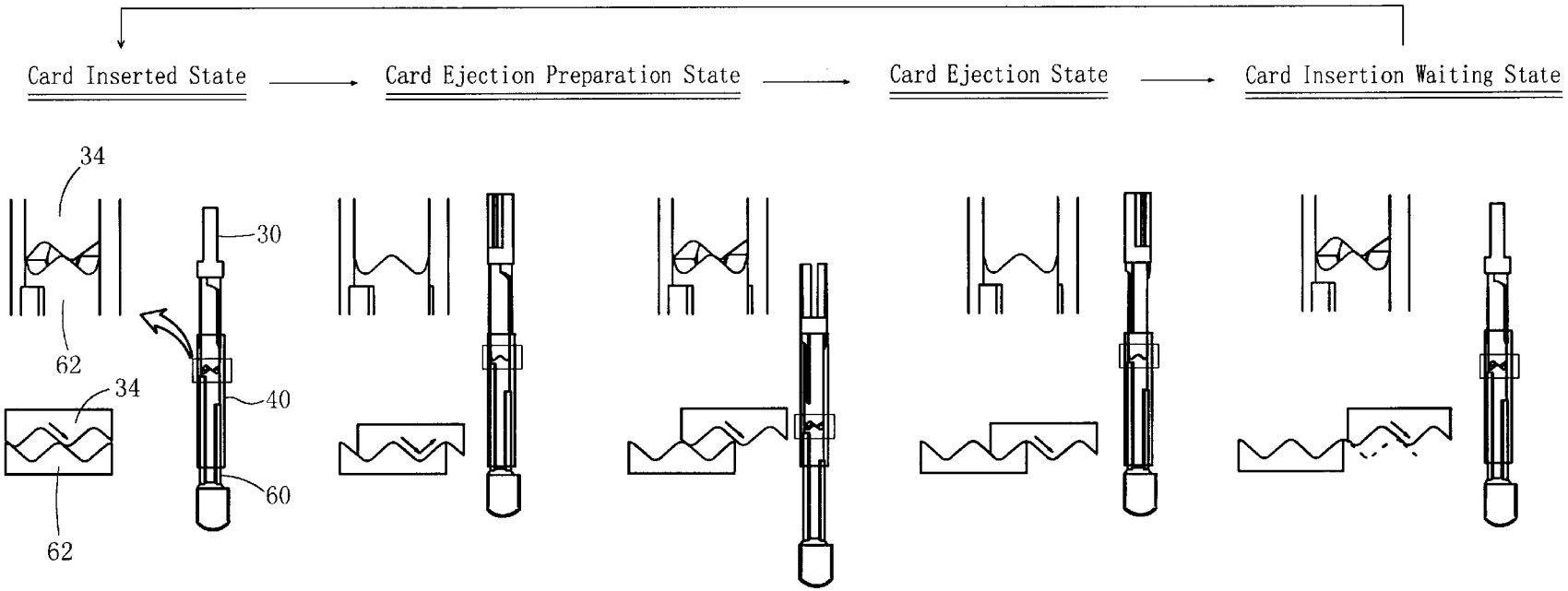
FIG. 13 is an explanatory drawing illustrating the states of rotation of the shifting-side wave-shaped cam of the rotary shaft and the fixed-side wave-shaped cam of the pushrod according to the reciprocation of the pushrod.
Figure 14:
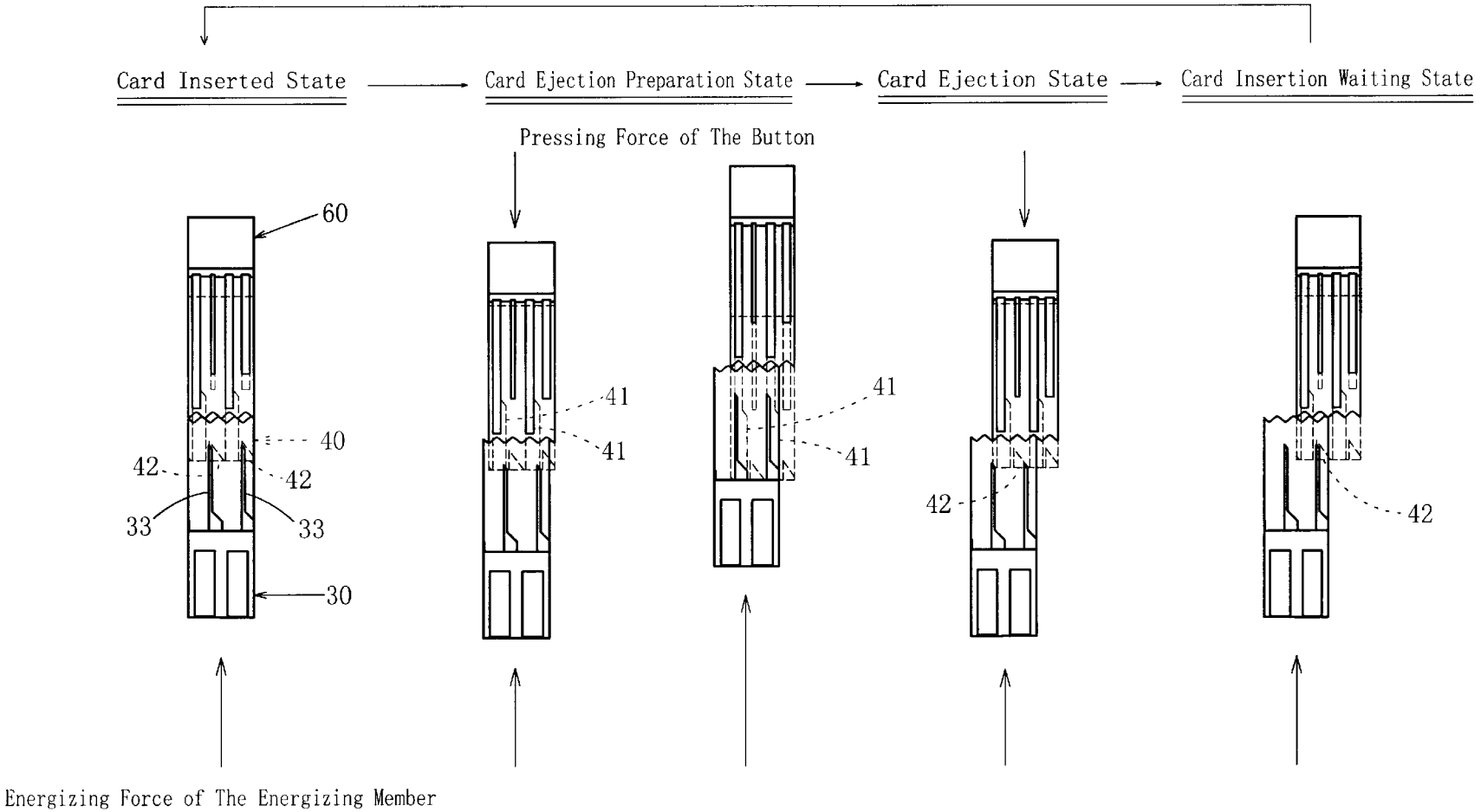
FIG. 14 is an explanatory drawing illustrating the state of the rotary shaft including the holder cylinder according to the reciprocation of the pushrod.

Next, the actions of the electric connector for cards of the embodiment will be explained with reference to FIG. 12 through FIG. 14. In each figure, the first explanatory drawing on the left, which has an indication of "card inserted state," shows the state when the respective members are in the initial state. In other words, the guide protrusions 33 of the rotary shaft 30 are in the shorter second guide grooves 42 of the holder cylinder 40. As the second guide grooves 42 are shorter, the length of insertion of the rotary shaft 30 into the holder cylinder 40 gets shorter, and in turn, the pushrod 60 goes deeper into the holder cylinder 40, and the protrusion of the pushrod 60 out of the holder cylinder 40 gets shorter. Under this condition, the engagement part 31 of the rotary shaft 40 moved away from the passage space S of the slider 22, and the escapement part 32 is oriented toward but spaced away from the passage space S of the slider 22. Accordingly, the slider 22 of the ejection mechanism 20 is pushed by the card 1 being inserted into the connection position to advance from the second position to the first position. This advancement, however, does not make the slider 22 contact the rotary shaft 30 nor make the rotary shaft 30 or the pushrod 60 move.

When the card 1 is to be discharged, as shown in the second and third explanatory drawings from the left, of each figure, which are indicated with "card ejection preparation state," the button 63 is pushed once against the energizing force of the energizing member 50 and released. Then the pushrod 60 will make a single reciprocation in the axial direction. As shown in the second explanatory drawing, in the outward movement, the pushrod 60 pushes the rotary shaft 30 and makes the guide protrusions 33 come out of the holder cylinder 40, and makes the shifting-side wave-shaped cam 34 slide along the fixed-side wave-shaped cam 62 to rotate the rotary shaft 30 in one direction. Next, as shown in the third explanatory drawing, in the homeward movement, the guide protrusions 33 get into the adjoining guide grooves 41. As the first guide grooves 41 are longer, the length of insertion of the rotary shaft 30 into the holder cylinder 40 gets longer. As a result, the pushrod 60 is pushed out of the holder cylinder 40 by the difference in length between the guide grooves 41, 42. The protrusion of the pushrod 60 out of the holder cylinder 40 gets longer in comparison with that in the initial position. Under this condition, the engagement part 31 of the rotary shaft 30 gets into the passage space S of the slider 22 and engages with the slider 22 on the side of preventing its advancement. Accordingly, as shown in the fourth explanatory drawing from the left of each figure, which is indicated with "card ejection state," when the button 63 is pushed once more against the energizing force of the energizing member 50 and released, the pushrod 60 will make a reciprocation in the axial direction, and as shown in the fourth explanatory drawing, in the outward movement, the pushrod 60 pushes the rotary shaft to make the guide protrusions 33 come out of the holder cylinder 40 and makes the shifting-side wave-shaped cam 34 slide along the fixed-side wave-shaped cam 62 to rotate the rotary shaft 30 in one direction. In the homeward movement, the guide protrusions 33 get into the adjoining second guide grooves 42 to reach the "card insertion waiting state" shown in the fifth explanatory drawing. In the outward movement, the engagement part 31 engages with the slider 22 to push back the slider 22 from the first position to the second position, and the card 1 is pushed out from the connection position in the discharge direction. When the card 1 is inserted in this "card insertion waiting state," the slider 22 will advance from the second position to the first position, and the respective members will return to the initial positions indicated in the respective drawings with "card inserted state."

As explained above, the electric connector for cards of this embodiment is provided with the rotary shaft 30, which engages with and disengages from the slider 22 and gives an ejecting force to the slider 20 when the rotary shaft 30 engages with the slider 22, and switching between the engagement with or disengagement from the slider 22 is made by rotation of the rotary shaft 30, and this rotation is effected by the use of wave-shaped cams 34, 62. Hence the rotary shaft 30, holder cylinder 40, pushrod 60, etc. can be formed of the same material such as resin, and in turn, in comparison with the connector with an ejection mechanism using a heart-shaped cam groove, countermeasures against wearing of members are not required and the cost can be reduced. Moreover, as members do not shift in plane but carry out a rotary shift, space-saving can be improved, and with improvement in ease of assembly, the reduction in cost is advanced further.

The ejection mechanism may have other structures provided that it exhibits functions that the ejection mechanism has a slider, which linearly reciprocates between a first position and a second position, and when a card is inserted into the connection position, the slider will be pushed by the card to advance from the second position to the first position, and when the slider is pushed back from the first position to the second position, the ejection mechanism will push out the card from the connection position in the discharge direction. However, as is the case of the above-mentioned embodiment, when the ejection mechanism 20 is structured to have an ejection member 21, which slides in the insertion direction of the card 1 and contacts the top end side 1*a* of the card 1, a slider 22, which is slidably provided on the body 10, and a linkage 23 connecting the ejection member 21 and the slider 22, the ejection mechanism can be realized by a simple mechanism and this has significant merits in terms of ease of assembly and cost.

Figure 15A:
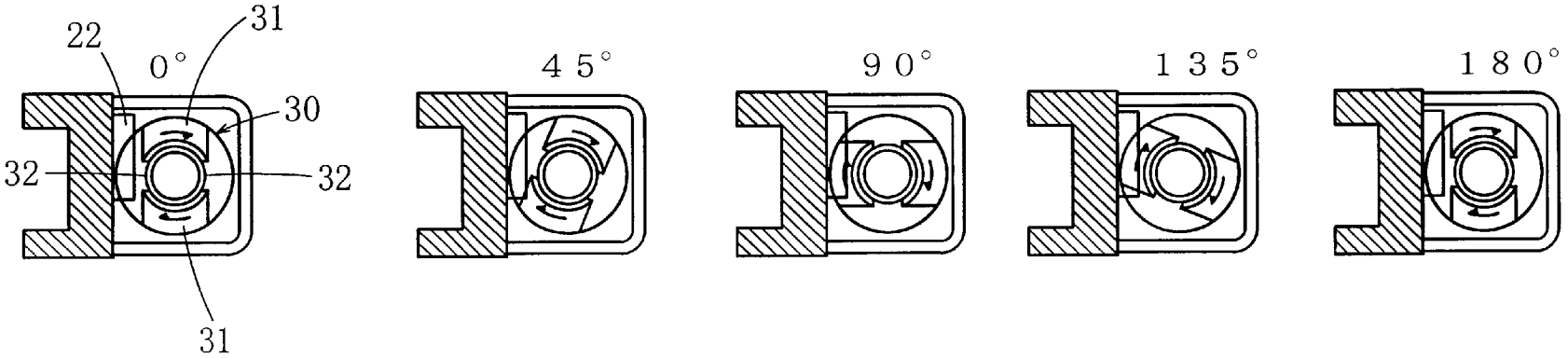
FIG. 15A and FIG. 15B indicate angles of rotation of the rotary shaft in one cycle starting from the initial position and ending in the initial position.
Figure 15B:
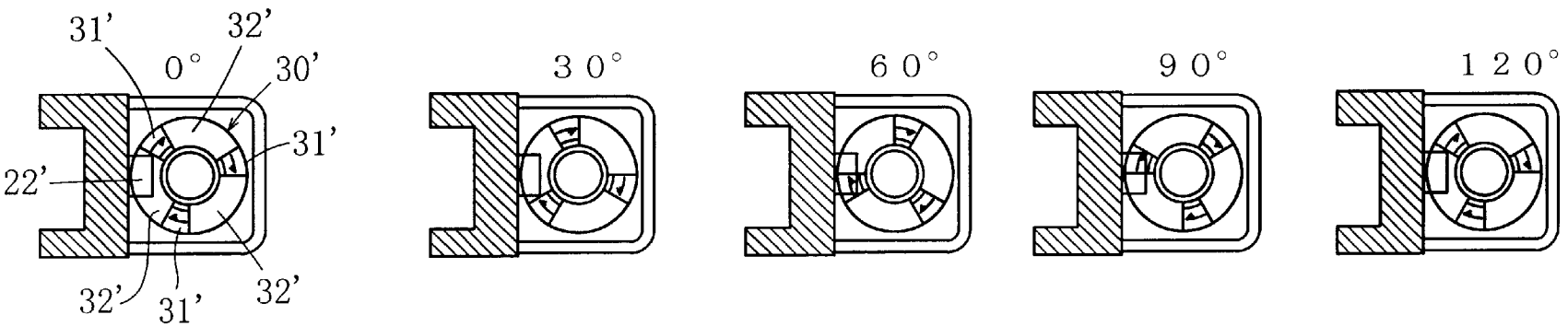

The present invention does not limit the numbers of the engagement part and the escapement part, and the numbers of the first guide groove and the second guide groove. However, as is the case of the above-mentioned embodiment, when two engagement parts 31 and two escapement parts 32 are provided and the engagement parts 31 and the escapement parts 32 are alternately arranged on the rotary shaft 30 in its circumferential direction, and two first guide grooves 41 and two second guide grooves 42 are provided and the first guide grooves 41 and two second guide grooves 42 are alternately arranged on the holder cylinder in its circumferential direction, the following effects will be obtained. When this arrangement is compared with the case shown in FIG. 15B, wherein three or more of each of engagement part 31', escapement part 32', first guide groove and second guide groove are provided, we can see that in the above-mentioned embodiment shown in FIG. 15A the width of the engagement part 31 in the circumferential direction can have a dimension sufficient to secure a strength necessary to push the slider 22. 22' in FIG. 15B denotes a slider, and 30' denotes a rotary shaft, respectively. As shown in FIG. 15A, the angle of rotation, which is made by the rotary shaft 30 in its cycle from the initial position to the initial position again is about 180 degrees. In comparison with the case wherein one engagement part 31, one escapement part 32, one first guide groove 41 and one second guide groove 42 are provided, the angle is halved. Accordingly, the wear due to frictions of contacting parts is reduced.

The present invention includes all embodiments that combine the features of the above-mentioned embodiments.

With the description of these embodiments, the first electric connector for cards, which was described in Summary above, has been fully disclosed. Furthermore, with the description of these embodiments, the second electric connector for cards and the third electric connector for cards, which will be described below, have been fully explained.

The second electric connector for cards is an electronic connector for cards according to the first electric connector for cards wherein the above-mentioned ejection mechanism comprises an ejection member, which slides in the card insertion direction to contact the top end side of the card, a slider being slidably provided on the body, and a linkage connecting the ejection member and the slider. With this arrangement, when the card is inserted to the connection position, the ejection member will be pushed by the card to slide and the linkage will be swung, and this will make the slider advance from the second position to the first position. When the slider is pushed back from the first position to the second position, the linkage will be swung, and this will make the ejection member slide, and the card will be pushed out by this ejection member from the connection position in the discharge direction. Thus the ejection mechanism can be realized with a simple mechanism, and this has significant merits in terms of ease of assembly and cost.

The third electric connector for cards is an electronic connector for cards according to the first or second electric connector for cards wherein two engagement parts and two escapement parts are provided, and these engagement parts and escapement parts are alternately arranged on the rotary shaft in the circumferential direction, and two first guide grooves and two second guide grooves are provided, and the first guide grooves and the second guide grooves are alternately arranged in the holder cylinder in the circumferential direction. With this arrangement, in comparison with cases wherein three or more of each of the engagement part, escapement part, first guide groove and second guide groove are provided, the width of the engagement part in the circumferential direction can have a sufficient dimension required to secure a strength for pushing the slider. Hence this is advantageous in terms of strength. Moreover, the angle of rotation of the rotary shaft in one cycle from the initial position to the initial position again is about 180 degrees. Thus the angle of rotation is halved in comparison with the case wherein the number of each of the engagement part, escapement part, first guide groove, and second guide groove is one. This reduces the risk of damage of the contacting parts due to friction.

What is claimed is:

1. An electrical connector arrangement for removably receiving and connecting an electronics card, comprising:

a body with a space into which an electronics card may be inserted;

an electrical connector situated in said space to have the card removably electrically connectable thereto;

an ejection member movably connected to said body to be selectively movable between an inactive position allowing the card to be electrically connected to said electrical connector and an ejection position to push the card in an ejection direction away from said electrical connector and out of said space;

a slider that is slidably connected to said body and coupled to said ejection member, so that said slider is slidable between a first slider position wherein said ejection member is in said inactive position and a second slider position wherein said ejection member is in said ejection position; and a push-button actuator mechanism that is selectively engaged with said slider to selectively slide said slider from said first position to said second position;

wherein said push-button actuator mechanism comprises:

a pushrod that has a push-button on a first end of said pushrod and a pushrod cam on a second end of said pushrod opposite said first end of said pushrod, and that is axially slidably and non-rotatably connected to said body so that, relative to said body, said pushrod is not rotatable but is axially movable along a longitudinal axis thereof alternately in a first axial direction in which said push-button is oriented and in a second axial direction opposite said first axial direction;

a rotary shaft that is coupled to said pushrod so as to be rotatable relative to said pushrod and to be axially slidable with said pushrod, and that is axially slidably and rotatably held relative to said body so that, relative to said body, said rotary shaft is rotatable and axially movable along a longitudinal axis of said rotary shaft which coincides with said longitudinal axis of said pushrod; and wherein said rotary shaft has opposite first and second ends; wherein said rotary shaft further has a rotary shaft cam on a said first end of said rotary shaft adjacent to said pushrod cam of said pushrod; and wherein said rotary shaft further has an outer perimeter surface proximate to said second end of said rotary shaft, wherein said outer perimeter surface includes at least one escapement part and at least one engagement part respectively at respective different circumferential portions of said outer perimeter surface; and a biasing member that exerts a biasing force on said rotary shaft relative to said body, to urge said rotary shaft cam into contact against said pushrod cam and to bias said rotary shaft toward axially sliding in said first axial direction;

wherein said engagement part protrudes farther than said escapement part radially outwardly from said longitudinal axis, and said rotary shaft is positioned so that said engagement part will engage with said slider when said rotary shaft is rotationally oriented in an engagement rotational orientation with said engagement part oriented toward said slider and so that said escapement part will be clear and disengaged from said slider when said rotary shaft is rotationally oriented in a non-engagement rotational orientation with said escapement part oriented toward said slider; and wherein said pushrod cam comprises a pushrod cam surface with an undulating wave contour in a circumferential direction on said second end of said pushrod, said rotary shaft cam comprises a rotary shaft cam surface with an undulating wave contour in a circumferential direction on said first end of said rotary shaft, and said pushrod cam surface and said rotary shaft cam surface cooperate with each other so that axial sliding of said pushrod alternately in said first axial direction and said second axial direction effects a rotating movement of said rotary shaft.

2. The electrical connector arrangement according to claim 1, further comprising a holder cylinder fixedly connected to said body, wherein:

said holder cylinder axially slidably and non-rotatably connects said push rod to said body;

said rotary shaft has at least one guide protrusion extending parallel to said longitudinal axis on an outer circumference of said rotary shaft between said first end of said rotary shaft and said engagement part;

said holder cylinder has an internal circumferential surface bounding an internal passage therein, said internal circumferential surface includes at least one relatively longer first guide groove and at least one relatively shorter second guide groove respectively extending parallel to said longitudinal axis along said internal passage from an end of said holder cylinder;

said pushrod is axially slidingly received with said second end of said pushrod in said internal passage of said holder cylinder, and said rotary shaft is received with said first end of said rotary shaft in said internal passage of said holder cylinder;

said relatively longer first guide groove is located at a first circumferential position in said internal passage so that said rotary shaft will be in said engagement rotational orientation when said guide protrusion slides into said first guide groove, and said relatively shorter second guide groove is located at a second circumferential position in said internal passage so that said rotary shaft will be in said non-engagement rotational orientation when said guide protrusion slides into said second guide groove; and when said pushrod is axially moved to a maximum extent in said second axial direction, said pushrod will push said rotary shaft in said second axial direction sufficiently to slide said guide protrusion out of a respective one of said guide grooves, and said rotating movement of said rotary shaft effected by said pushrod cam surface and said rotary shaft cam surface cooperating with each other will move said guide protrusion to come into alignment with a next adjacent one of said guide grooves.

3. The electrical connector arrangement according to claim 2, wherein said at least one engagement part includes exactly two said engagement parts, said at least one escapement part includes exactly two said escapement parts, said two engagement parts and said two escapement parts are arranged alternately in a circumferential direction of said rotary shaft, said at least one first guide groove includes exactly two said first guide grooves, said at least one second guide groove includes exactly two said second guide grooves, and said two first guide grooves and said two second guide grooves are arranged alternately in a circumferential direction of said internal passage of said holder cylinder.

4. The electrical connector arrangement according to claim 1, further comprising a linkage that connects said slider to said ejection member, and wherein said ejection member is arranged to contact an end side of the card.

5. The electrical connector arrangement according to claim 1, wherein said rotary shaft and said pushrod are entirely made of a same material.

6. The electrical connector arrangement according to claim 5, wherein said material is a resin.

7. An electrical connector arrangement for removably receiving and connecting an electronics card, comprising:

a body with a space into which an electronics card may be inserted;

an electrical connector situated in said space to have the card removably electrically connectable thereto;

an ejection member movably connected to said body to be selectively movable between an inactive position allowing the card to be electrically connected to said electrical connector and an ejection position to push the card in an ejection direction away from said electrical connector and out of said space;

a slider that is slidably connected to said body and coupled to said ejection member, so that said slider is slidable between a first slider position wherein said ejection member is in said inactive position and a second slider position wherein said ejection member is in said ejection position; and a push-button actuator mechanism that is selectively engaged with said slider to selectively slide said slider from said first position to said second position;

wherein said push-button actuator mechanism comprises:

a pushrod that is axially slidable alternately in opposite directions longitudinally along said pushrod;

a rotary shaft that is axially slidable alternately in opposite directions in line with or parallel to said opposite directions longitudinally along said pushrod and that is rotationally movable;

means including pushrod cam means provided on said pushrod and rotary shaft cam means provided on said rotary shaft and cooperating with said pushrod cam means for causing a rotational movement and an axial sliding movement of said rotary shaft responsive to an axial sliding movement of said pushrod alternately in said opposite directions longitudinally along said pushrod; and means for selectively engaging said rotary shaft with said slider when said rotary shaft is in a first rotational orientation and for selectively disengaging said rotary shaft from said slider when said rotary shaft is in a second rotational orientation different from said first rotational orientation.

* * * * *

UNITED STATES PATENT AND TRADEMARK OFFICE

CERTIFICATE OF CORRECTION

PATENT NO. : 6,609,918 B2
DATED : August 26, 2003
INVENTOR(S) : Uchikawa

It is certified that error appears in the above-identified patent and that said Letters Patent is hereby corrected as shown below:

Drawings,
Replace the Fig. 6A by the following:

FIG. 6A

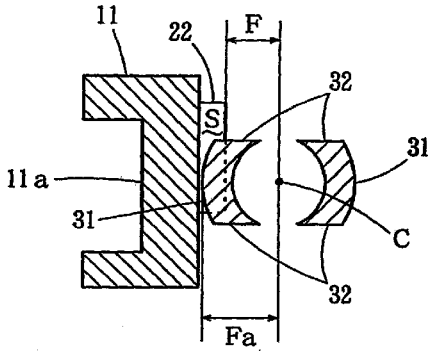

Column 11,
Line 49, after "on" delete "a".

Signed and Sealed this

Fourth Day of November, 2003

JAMES E. ROGAN
*Director of the United States Patent and Trademark Office*